United States Patent [19]

Morrissey

[11] 4,186,064

[45] Jan. 29, 1980

[54] METHOD AND ELECTROLYTE FOR ELECTRODEPOSITION OF BRIGHT GOLD AND GOLD ALLOYS

[75] Inventor: Ronald J. Morrissey, Cranston, R.I.

[73] Assignee: Technic, Inc., Providence, R.I.

[21] Appl. No.: 922,981

[22] Filed: Jul. 10, 1978

Related U.S. Application Data

[63] Continuation-in-part of Ser. No. 817,200, Jul. 20, 1977, abandoned.

[51] Int. Cl.[2] ..... C25D 3/48; C25D 3/62

[52] U.S. Cl. ..... 204/43 G; 204/DIG. 2; 204/46 G; 260/429 J; 260/439 R

[58] Field of Search ..... 204/43 G, 46 G, 44, 204/48, DIG. 2; 260/439 R, 429 J

[56] References Cited

U.S. PATENT DOCUMENTS

| | | | |
|---|---|---|---|
| 3,149,057 | 9/1964 | Parker et al. | 204/43 G X |
| 3,475,293 | 10/1969 | Haynes et al. | 204/48 |
| 3,672,969 | 6/1972 | Nobel et al. | 204/43 G |
| 3,728,366 | 4/1973 | Michlmayr | 260/439 R |
| 3,755,396 | 8/1973 | Brooks | 260/439 R |
| 3,856,638 | 12/1974 | Bick et al. | 204/43 G |
| 3,864,222 | 2/1975 | Wilson et al. | 204/43 G |
| 3,870,619 | 3/1975 | Weisberg et al. | 204/43 G |
| 3,990,954 | 11/1976 | Foulke et al. | 204/46 G |
| 4,020,091 | 4/1977 | Budnick | 260/439 R X |
| 4,076,598 | 2/1978 | Lerner et al. | 204/43 G |
| 4,116,990 | 9/1978 | Budnick | 260/429 J |

FOREIGN PATENT DOCUMENTS

| | | | |
|---|---|---|---|
| 2023304 | 11/1970 | Fed. Rep. of Germany | 204/48 |

OTHER PUBLICATIONS

Sonya J. Westerback et al., Nature, pp. 321–322, Aug. 11, 1956.

*Primary Examiner*—G. L. Kaplan

*Attorney, Agent, or Firm*—Ostrolenk, Faber, Gerb & Soffen

[57] ABSTRACT

Bright gold or gold alloy electroplating employing a preformed fully neutralized salt of a cobalt or nickel metal organophosphorus chelate as the brightening agent.

16 Claims, 2 Drawing Figures

METHOD AND ELECTROLYTE FOR ELECTRODEPOSITION OF BRIGHT GOLD AND GOLD ALLOYS

BACKGROUND OF THE INVENTION

This is a continuation-in-part of application Ser. No. 817,200 filed July 20, 1977 and now abandoned.

This invention relates to the electrodeposition of mirror-bright gold or gold alloy deposits from aqueous electrolytes containing a soluble gold cyanide and a chelate or chelates formed by the reaction of cobalt or nickel with certain organophosphorus compounds.

Rinker and Duva, U.S. Pat. No. 2,905,601, first taught the addition of simple salts of codepositable metals typically the cobalt sulfate, or nickel sulfamate, to acid gold plating baths. This approach is limited by the fact that the amount of codepositable cobalt or nickel needed to effect brightening is restricted, in practice, to the order of 0.1 gram per liter. Smaller amounts are ineffective, and larger amounts lead to excessive amounts of cobalt or nickel in the deposit. It is thus necessary to maintain very close analytical control for cobalt or nickel in a bath of this type.

An alternative approach is to add a codepositable cobalt or nickel in the form of a chelate, as first described for cobalt by Parker and Powers, in U.S. Pat. No. 3,149,057 and for nickel in U.S. Pat. No. 3,149,058. This approach offers the advantages that: (a) the amount of codepositable cobalt or nickel metal in the bath can be significantly higher than if added as a simple salt, which facilitates analytical control; and (b) by choosing an appropriate chelating agent or agents, it is possible to control the deposition potential of codepositable cobalt or nickel metal so as to effect brightening of the gold deposit over predetermined wide ranges of current density.

The addition of a cobalt or nickel chelate to a gold electroplating bath can be accomplished in either of two ways: (i) the chelating agent and a soluble simple cobalt or nickel salt are added separately to the electrolyte and the chelation reaction is allowed to proceed in situ. A typical example of this approach is given by Nobel and Ostrow in Example III of U.S. Pat. No. 3,672,969. In this example, and typically when using this approach, the chelating agent is a major constituent of the electrolyte. It must thus fulfill all or a significant portion of the conducting and buffering functions of the bath; and since it is present in large excess of the amount of added cobalt or nickel, only a single chelated cobalt or nickel species is present in the resulting bath.

The alternate procedure to the foregoing is (ii) to manufacture the cobalt or nickel chelate or chelates in a separate process or processes, and to add the resulting chelated cobalt or nickel compound or compounds to the electroplating bath in finished form. This latter approach is taught by the aforementioned Parker and Powers patents, and has the advantage that free chelating agent is not necessarily a major constituent of the plating electrolyte. It is thus possible to choose from a very large number of appropriate electrolyte materials so as to optimize the conducting and buffering properties of the resulting bath at will, and to add to the bath any of a number of chelated cobalt or nickel species, either singly or in combination.

Accordingly, it is an object of the invention to provide a series of chelated cobalt or nickel compounds capable of brightening gold or gold alloy electrodeposits from aqueous electrolytes containing a soluble gold cyanide. It is a further object of the invention to provide said chelated cobalt or nickel compounds in a form such that they can be employed either singly or in combination in any of a wide variety of electrolytes. It is a further object of the invention to provide electrolytic solutions and electroplating baths containing gold in the form of a soluble cyanide, together with appropriate electrolyte materials to provide electrical conductivity and buffering ability, to which are added chelated cobalt or nickel species, either individually or in combination, for the purpose of obtaining bright gold or gold alloy electrodeposits.

DRAWINGS

In the drawings:

FIG. 1 compares the absorption spectra of a solution according to this invention at various values of pH.

FIGS. 1 and 2 are more specifically described hereafter.

DESCRIPTION OF THE INVENTION

It has been found that when one or more soluble cobalt salts is added to an electrolytic solution containing one or more chelating organophosphorus compounds of formula $$R'_{(3-n)}-N-[R-\overset{\overset{\displaystyle O}{\|}}{P}-(OH)_2]_n$$

(where R is a lower alkylidene radical or water-soluble salt thereof, R' is hydrogen or a lower alkyl or carboxyalkyl radical, and n is an integer from 1 to 3), or $$[(HO)_2-\overset{\overset{\displaystyle O}{\|}}{P}-R]_x-\overset{\overset{\displaystyle R'_{(2-x)}}{|}}{N}-(CH_2)_y-\overset{\overset{\displaystyle R'_{(2-x)}}{|}}{N}-[R-\overset{\overset{\displaystyle O}{\|}}{P}-(OH)_2]_x$$

(where R and R' are as described above, x is an integer from 1 to 2, and y is an integer from 1 to 6), and the pH of the resulting solution is raised by the addition of a suitable base, a pronounced color shift from dark red to an intense purple is produced at pH values above about 7.0. It is believed this phenomenon indicates the formation of a highly stable chelated cobalt species.

When a soluble nickel salt is substituted for cobalt in the same solution and under the same conditions described above, a color shift from dark green to "brownish" green is observed.

Figure 1:
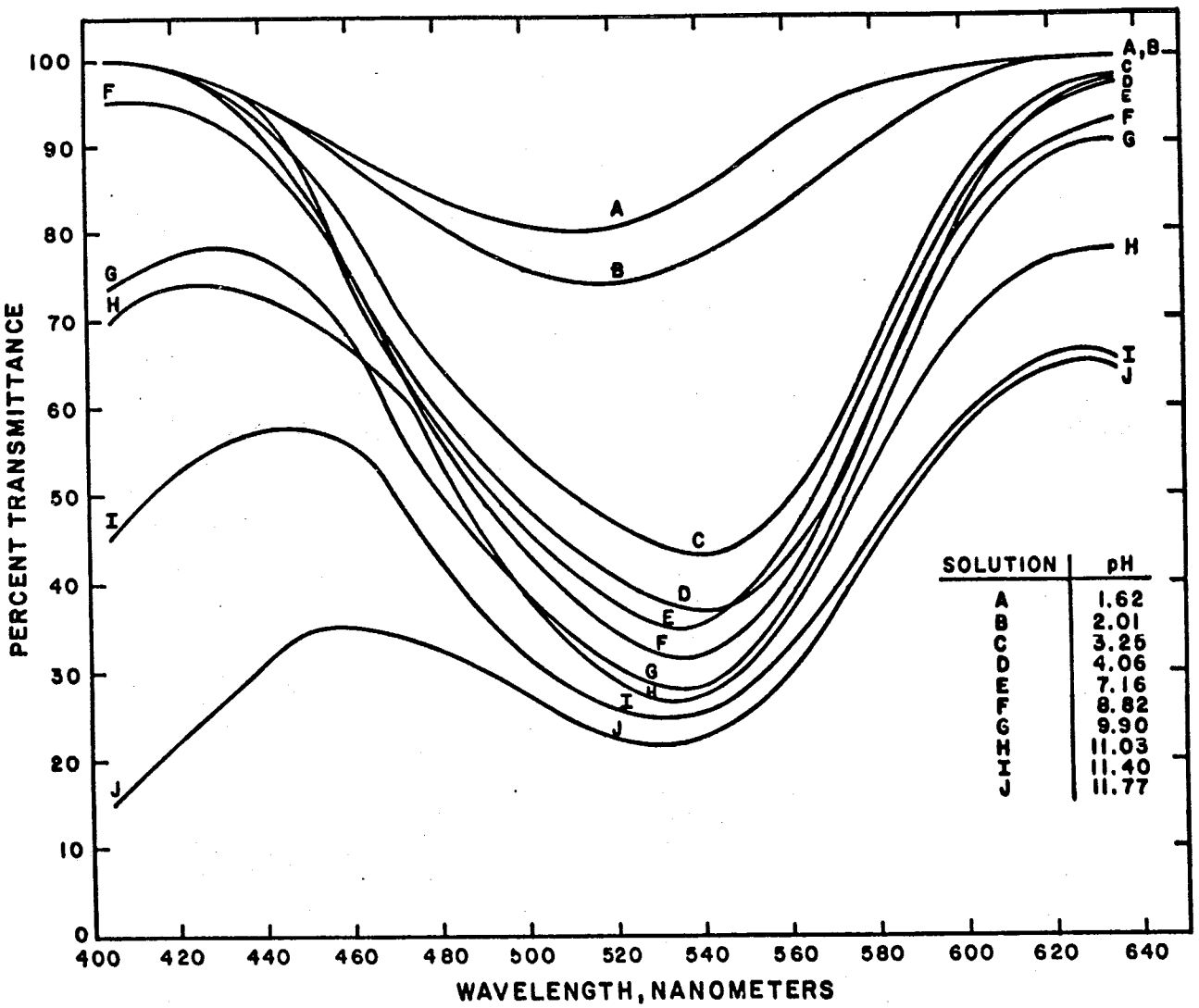

An illustration of the color shift observed in cobalt solutions is shown in FIG. 1, which depicts a series of absorption spectra in the visible range of an aqueous solution containing 1.0 gram cobalt per liter (added as $CoCl_2$) and 5.07 grams of nitrilotri (methylene phosphonic acid) per liter. These amounts are in stoichiometric ratio, assuming that one gram atomic weight of cobalt is complexed by one gram molecular weight of the chelating agent. The solution was neutralized in steps by addition of small increments of solid KOH, an aliquot of solution being withdrawn for spectrophotometric analysis and pH determination after each addition of KOH. The curves shown in FIG. 1 indicate a significant decrease in solution transmittance in the violet (wavelengths shorter than 420 nanometers) at pH values above 7.16, and it is at these pH values that the transition from dark red to purple coloration takes place.

Aqueous solutions containing cobalt chelates of these organophosphorus compounds, when neutralized to purple coloration in this fashion, can be added to aqueous gold electroplating baths such that said baths can be operated at pH values up to and exceeding 6.0 and at cobalt metal concentrations up to and exceeding 1.3 grams per liter producing mirrorbright gold deposits at very high current efficiencies (up to and exceeding 80 percent) and over a current density range from near zero up to and exceeding 100 amperes per square foot. In the prior art, it had been considered impossible, as a practical matter, to operate a cobalt-brightened gold plating bath at pH values substantially above 5.0. It will be shown below that at comparable concentrations of gold, a plating bath prepared according to the teaching of the instant invention deposits at an efficiency greater by 30 percent that a plating bath made up according to Example III of U.S. Pat. No. 3,672,969.

Figure 2:
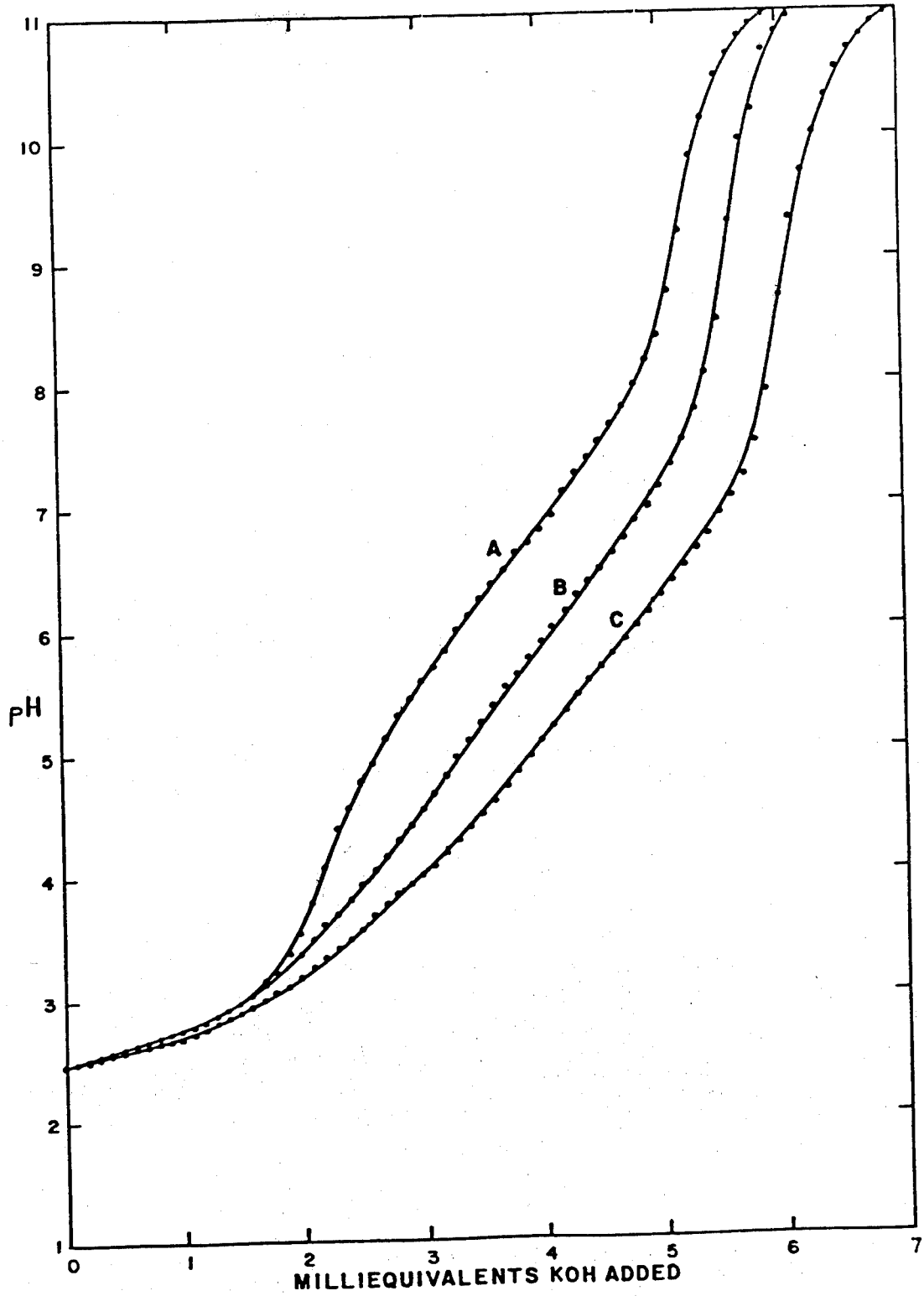
FIG. 2 shows titration curves for a series of solutions.

In order to identify the chelated cobalt species responsible for the intense purple coloration of the solutions previously referred to, neutralization titrations were performed on solutions containing known amounts of various organophosphosphorus chelating agents, both in the presence and in the absence of known amounts of added cobalt ion. FIG. 2 shows titration curves for a series of solutions, each containing 1 millimole of nitrilotri (methylene phosphonic acid). The titrant used was 1.0 molar KOH. Curve A of FIG. 2 is a plot of pH versus milliequivalents of KOH added to a solution containing 1.0 millimole of nitrilotri (methylene phosphonic acid) with no added cobalt. This plot shows two end points at 2.2 and 5.1 milliequivalents of KOH added. These values can be rounded off to the nearest whole numbers, as commercial nitrilotri (methylene phosphonic acid) is in the form of an aqueous solution stated by the manufacturer to be in the range of 48–52% active material by weight. Addition of this compound were made on the basis of an assumed concentration of 50.0% active material by weight. Nitrilotri (methylene phosphonic acid) has a total of 6 reactive protons per molecule, and the results shown in Curve A indicate that neutralization to pH 11 with KOH removes 5 of these.

Curve C in FIG. 2 is a plot of pH versus milliequivalents of KOH added to a solution containing 1.0 millimole of nitrilotri (methylene phosphonic acid) and 1.0 milli atomic weight of cobalt (added as $CoCl_2$). In this curve, a single end point occurs at 6.0 milliequivalents of KOH added, indicating that in the presence of a stoichiometric amount of cobalt, all of the reactive protons of nitrilotri (methylene phosphonic acid) are neutralized; two by cobalt, and the remainder by added KOH. The color of the solution at the end point is intense purple, corresponding to that noted previously.

Titration by 1.0 molar KOH of a solution containing 1.0 millimole of nitrilotri (methylene phosphonic acid) and 2.0 milli atomic weights of cobalt yields a titration curve identical to Curve C.

Titration by 1.0 molar KOH of a solution containing 1.0 millimole of nitrilotri (methylene phosphonic acid) and one-half milli atomic weight of cobalt yields Curve B, with a single observed end point at 5.5 milliequivalents of KOH added, indicating the presence of one-half milliequivalent of unreacted chelating agent.

From this data, it is concluded:

(1) that one molecule of nitrilotri (methylene phosphonic acid) complexes one atom of cobalt, (2) that the chelated cobalt species present at the end point in titrations such as those described here is the tetrapotassium salt of cobalt nitrilotri (methylene phosphonic acid), and (3) that this species is the species responsible for intense purple coloration of the solution, and is the species which constitutes an effective brightening agent when added to gold electroplating baths.

As a further means of identifying the chelated cobalt species, a solution was made up containing 1.0 gram (0.017 mole) of cobalt (as $CoCl_2$) and 5.07 grams (0.017 mole) of nitrilotri (methylene phosphonic acid). To this was added 102 milliliters of 1.0 molar KOH (0.102 mole$=6\times0.017$). The resulting solution was evaporated to dryness, and the residue collected for elemental analysis by an independent laboratory, (Schwartzkopf Analytical Laboratory). The elemental analysis yielded weight percentage as follows: Carbon, 4.48%; Hydrogen, 2.32%; Nitrogen, 1.59%; Phosphorus, 12.97%; Potassium, 29.78%; Cobalt, 8.49%; the remainder, or 40.37%; being considered weights as oxygen. Dividing these values by the respective atomic weights of the elements, one obtains the following ratios, which correspond to the number of gram atomic weights of each element present in a 100 gram sample: Carbon, 0.373; Hydrogen, 2.302; Nitrogen, 0.113; Phosphorus, 0.419; Potassium, 0.762; Cobalt, 0.144; Oxygen 2.523. Since nitrogen shows the smallest of these ratios, one may assume that it occurs as one atom per molecule of complex. Dividing the above ratios by the ratio 0.113 for nitrogen, yields the empirical formula $$C_{3.3}H_{20.4}N_1P_{3.7}O_{22}Co_{1.3}K_{6.7}$$

which, within experimental error, corresponds to the formula $$K_4Co\ N\ (CH_2PO_3).\ 11\ H_2O\ .\ 2\ KCL$$

which is the hydrated form of the tetrapotassium salt of cobalt nitrilotri (methylene phosphonic acid), with two milliequivalents KCl formed as indicated.

Neutralization titrations were also performed on solutions containing 1.0 millimole of N-carboxymethyl, N, N-di (methylene phosphonic acid). The results of these titrations are shown in tubular form as follows:

TABLE I

Neutralization Titrations of N-Carboxymethyl, N,N-di (methylene phosphonic acid)

| CHELANT | COBALT | MILLEQUIVALENTS KOH TO END POINT 1st | 2nd |
|---|---|---|---|
| 1 mmol | 0 | 2.0 | 4.0 |
| 1 mmol | 0.5 m.a.w. | — | 4.5 |
| 1 mmol | 1.0 m.a.w. | — | 5.0 |
| 1 mmol | 2.0 m.a.w. | — | 5.0 |

N-carboxymethyl, N, N-di (methylene phosphonic acid) has a total of 5 reactive protons per molecule, and the results obtained exactly parallel those shown for the previous case. One molecule of N-carboxymethyl, N, N-di (methylene phosphonic acid) is shown to complex one atom of cobalt, and the intensely colored species present at the end point is identified as the tripotassium salt of cobalt N-carboxymethyl, N, N-di (methylene phosphonic acid).

Neutralization titrations were also performed on solutions containing 1.0 millimole of ethylenediamine tetra (methylene phosphonic acid). The results of the series of titrations are shown in tabular form as follows:

TABLE II

Neutralization Titrations of Ethylenediamine Tetra (Methylene Phosphonic acid)

| CHELANT | COBALT | MILLIEQUIVALENTS KOH TO END POINT 1st | 2nd |
|---|---|---|---|
| 1 mmol | 0 | 2.7 | 5.3 |
| 1 mmol | 0.5 m.a.w. | — | 6.4 |
| 1 mmol | 1.0 m.a.w. | — | 6.9 |
| 1 mmol | 2.0 m.a.w. | — | 6.9 |

Ethylenediamine tetra (methylene phosphonic acid) has a total of 8 reactive protons per molecule, and in this case, the 8th proton is not neutralized by KOH even in the presence of cobalt. Again, one molecule of the chelating agent is found to complex one atom of cobalt, and in this case the intensely colored species present at the end point is identified as the pentapotassium salt of cobalt ethylenediamine tetra (methylene phosphonic acid). This species may be considered to be fully neutralized, as the 8th proton in ethylenediamine tetra (methylene phosphonic acid) is very strongly bound, and cannot be made to react with base under these conditions.

Neutralization titrations were also performed using 1.0 molar NaOH and 1.0 molar $NH_4OH$ as titrants. In each case, the equivalencies obtained were substantially identical to those shown above.

In view of the foregoing, it has been concluded that the intensely colored species present at the end point in titrations of organophosphorus chelating agents in the presence of cobalt ion, and which constitute effective brightening agents when added to gold electroplating baths, are the fully neutralized potassium, sodium, or ammonium salts of the cobalt chelate of the organophosphorus chelating agent employed. Similar results are obtained in titrations of organophosphorus chelating agents in the presence of nickel ion. Therefore, the colored species present at the end point in titrations of organophosphorus chelating agents in the presence of nickel ion, and which constitute effective brightening agents when added to gold electroplating baths, are the fully neutralized potassium, sodium, or ammonium salts of the nickel chelates of the organophosphorus chelating agent employed.

Specifically, organophosphorus chelating agents which have been found to form useful cobalt and nickel chelates for the purposes of this invention are as follows:

1. Nitrilotri (methylene phosphonic acid).

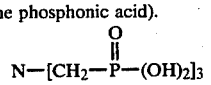

2. Nitrilotri (ethylidene phosphonic acid).

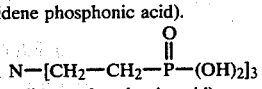

3. Nitrilotri (isopropylidene phosphonic acid).

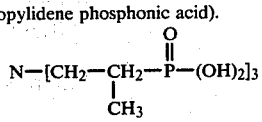

4. N-carboxymethyl, N, N-di (methylene phosphonic acid).

-continued

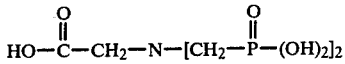

5. 1-Hydroxyalkylidene, 1,1 diphosphonic acid.

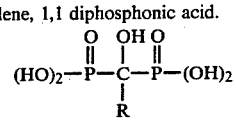

6. 1-Hydroxyethylidene, 1,1 diphosphonic acid.

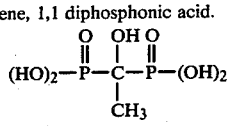

7. Ethylenediamine tetra (methylene phosphonic acid).

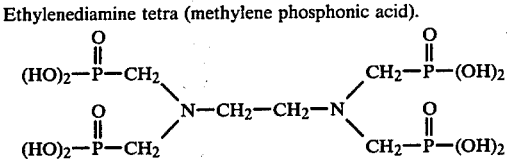

8. Ethylenediamine N,N'-di (carboxymethyl), N,N'- di (methylene phosphonic acid).

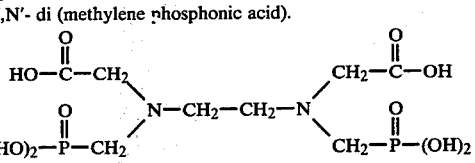

9. Hexamethylenediamine tetra (methylene phosphonic acid)

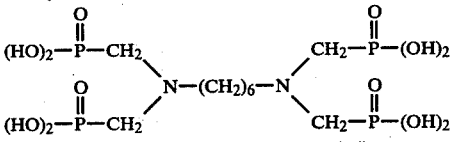

10. Hexamethylenediamine N,N'- di (carboxymethyl) N,N'- di (methylene phosphonic acid).

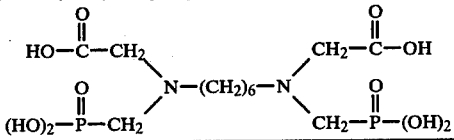

Chelated cobalt or nickel compounds useful for the purposes of this invention can be prepared by neutralization reactions similar to those discussed previously. Cobalt or nickel in the form of a suitable soluble salt such as the sulfate, chloride, or carbonate is dissolved into an aqueous solution containing at least a stoichiometric amount of the organophosphorus chelating agent, and the resulting solution is neutralized by addition of a suitable base such as KOH, NaOH, or $NH_4OH$. The cobalt or nickel chelate salts prepared in this manner can be separated from the solution by precipitation with ethanol or acetone and recovered as the solid compounds by filtration and washing with ethanol or acetone.

Gold alloys can be produced in accordance with this invention by the addition to the gold plating bath containing the soluble gold cyanide and conventional supporting electrolyte, of various alloying metals as known in the art, such as nickel, iron, zinc and copper, in the form of water soluble salts or metal chelates. It will also be appreciated that the plating bath can contain, if desired, other conventional additives for the purpose of increasing conductivity, increasing throwing power, buffering, and the like.

COMPARISON WITH PRIOR ART

In order to compare the instant invention with known plating complexes, two gold plating baths were made up as follows:

SOLUTION A 150 grams nitrilotri(methylene phosphonic acid)
4 grams potassium gold cyanide
0.946 grams $CoSO_4.7H_2O$ (0.25 gram cobalt)
water to 1 liter
pH adjusted to 4.3 by addition of KOH

SOLUTION B 44.91 grams monopotassium phosphate
123.64 grams tripotassium citrate
29.06 grams citric acid
1.32 grams cobalt as the tetrapotassium salt of cobalt nitrilotri (methylene phosphonic acid)
4.0 grams potassium gold cyanide
water to 1 liter
pH is 5.0

Solution A corresponds exactly to Example III of U.S. Pat. No. 3,672,969. In this solution, the chelating agent, in partially neutralized form, serves as the entire conducting and buffering agent for the bath, as well as to complex the cobalt.

Solution B constitutes an electroplating bath in accordance with the teaching of the instant invention. In this solution, phosphate and citrate salts serve as the conducting and buffering agents, and cobalt is added as the chelate in fully neutralized form.

Both solution A and Solution B yield mirror-bright gold deposits over current density ranges from near zero to approximately 10 amperes per square foot. Current efficiencies were determined for each bath at current densities of 2.0, 5.0, and 10.0 amperes per square foot. The results are shown in tabular form as follows:

TABLE III

CURRENT EFFICIENCIES OF GOLD ELECTROPLATING BATH

| Current Density, Amperes Per Square foot | Solution A 100° F. | Solution B 90° F. |
|---|---|---|
| 2.0 | 26.59% | 31.97% |
| 5.0 | 39.23% | 50.16% |
| 10.0 | 40.37% | 53.10% |

Solution B contains more than five times as much cobalt as solution A, yet the current efficiency obtained at comparable concentrations of gold is in all cases significantly higher for Solution B. At 10 amperes per square foot, the improvement in efficiency in the bath of the instant invention is greater than 30 percent.

In order to compare the nickel chelates of the present invention with those of the prior art, two gold electroplating baths were made up as follows:

SOLUTION C 44.91 grams monopotassium phosphate
78.73 grams tripotassium citrate
56.01 grams citric acid
2.11 grams nickel as the tetrapotassium salt of nickel nitrilotri (methylene phosphonic acid)
8.22 grams gold as potassium gold cyanide.
Water to one liter.

SOLUTION D

Sufficient water was used to form one liter of solution containing the following:

11.91 grams monopotassium phosphate
78.73 grams tripotassium citrate
56.01 grams citric acid
2.11 grams nickel as the monopotassium salt of nickel nitrilotriacetate
8.22 grams gold as potassium gold cyanide.

The pH of Solutions C and D is in each case 4.2, and the solutions themselves are chemically identical except for the particular nickel chelate employed as the brightening agent. Both solutions when tested in a Hull cell at 110° F. yield bright, smooth deposits over a current density range from near zero to over 25 amperes per square foot.

Current efficiencies were determined for Solutions C and D under identical conditions of temperature (110° F.), agitation, cell geometry, current density, etc., with results as follows:

| Current Density, ASF | Current Efficiency, % SOLUTION C. | SOLUTION D |
|---|---|---|
| 5.0 | 33.60 | 31.65 |
| 10.0 | 44.21 | 36.87 |
| 15.0 | 47.15 | 39.97 |
| 20.0 | 47.15 | 42.41 |

The current efficiencies obtained with Solution C, to which nickel was added as the preformed, fully neutralized salt of nickel nitrilotri (methylene phosphonic acid) are clearly superior to those obtained with Solution D, to which nickel is added as the potassium salt of nickel NTA. At 15 amperes per square foot, the improvement obtained is approximately 20 percent.

It can be hypothesized that if the reaction $$\text{Chelate (acid form)} \underset{k_2\ \text{(acid)}}{\overset{k_1\ \text{(Base)}}{\rightleftharpoons}} \text{Chelate (salt form)}$$

is a simple equilibrium, that is, if the rate constants $k_1$ and $k_2$ are equal, then the state of the cobalt chelate present in an actual plating bath is determined solely by the bath pH, in which case it should not matter whether the chelated cobalt species added to the bath is in fully or only partly neutralized form, or whether the chelation reaction is carried on in situ. Accordingly, experiments were carried out to determine the current efficiencies of identical gold electroplating baths at the same pH made up using, in one case, a simple mixture of a soluble cobalt salt together with free chelating agent, and in the other case, the fully neutralized potassium salt of the corresponding cobalt chelate.

Solutions were made up as follows:

I. Conducting Electrolyte 44.91 gm. Monopotassium Phosphate
123.65 gm. Tripotassium Citrate
38.31 gm. Citric Acid
Water to 1 liter. This solution is strongly buffered at a pH of about 5.1

II. Brightener Solution Alpha 47.6 gm. $CoSO_4.7H_2O$ (10.0 gm. cobalt metal)
50.7 gm. Nitrilotri (methylene phosphonic acid)
Water to 1 liter. pH not adjusted.

III. Brightener Solution Beta 47.6 gm. $CoSO_4.7H_2$ (10.0 gm. cobalt metal)
50.7 gm. Nitrilotri (methylene phosphonic acid)
Water to 1 liter. pH adjusted to 8.0 by addition of KOH to form the tetrapotassium salt of cobalt nitrilotri (methylene phosphonic acid).

From these solutions, two gold electroplating baths were formulated as follows:

IV. Gold Plating Bath Alpha 868 ml. Conducting Electrolyte
132 ml. Brightener Solution Alpha
12.24 gm. Potassium gold cyanide (8.2 gm. gold)
pH adjusted to 5.1 with KOH V. Gold Plating Bath Beta 868 ml. Conducting Electrolyte
132 ml. Brightener Solution Beta
12.24 gm. Potassium gold cyanide (8.2 gm. gold)
pH adjusted to 5.1 with Citric Acid The two plating baths were allowed to equilibrate for 72 hours prior to plating. Current efficiencies were then determined at various current densities at a temperature of 90° F. and the results are shown in Table IV:

TABLE IV

Current Efficiencies of Gold Electroplating Baths

| Current Density ampere per square foot | Bath Alpha | Bath Beta |
|---|---|---|
| 5.0 | 36.62% | 43.47% |
| 10.0 | 42.25% | 54.65% |
| 20.0 | 45.51% | 55.38% |
| 50.0 | 42.82% | 48.78% |

Both baths contain identical amounts of gold, cobalt and chelating agent, employ the same supporting electrolyte and are operated at the same temperature and pH. Yet the current efficiencies obtained with Bath Beta, to which the brightening agent is added in the form of the fully neutralized potassium salt, are significantly superior in each case to those from Bath Alpha, in which the chelation reaction was allowed to proceed in situ. These results are very strong evidence that the rate constants $k_1$ and $k_2$ referred to previously are not equal, and that therefore the addition of cobalt in the form of the fully neutralized potassium, sodium, or ammonium salt of the cobalt chelate of an organophosphonic acid chelating agent represents a novel and significant improvement in the operation of gold electroplating baths.

It is possible to generate the fully neutralized salt form of the cobalt or nickel chelate in situ by the simple expedient of raising the bath pH to the point at which the chelate salt is formed, and the readjusting to the pH desired for electrodeposition. As an example of this, the pH of Bath Alpha referred to above was raised to 8.0 by addition of KOH, and then readjusted to 5.1 by addition of citric acid. The current efficiency was then determined at a current density of 10 amperes per square foot at 90° F. This was found to be 63.87%, a significant increase from the original value of 42.25%. It is clear that this procedure of pH adjustment and readjustment produces a large increase in the bath current efficiency, and that the increase results from conversion of the cobaltous ion to the fully chelated cobalt phosphonate.

The following example further illustrate the present invention:

EXAMPLE 1

A sufficient amount of water was used to form one liter of a gold electroplating solution to which was added the following:

123.65 grams tripotassium citrate
44.91 grams monopotassium phosphate
31.70 grams citric acid
1.32 grams cobalt in the form of the pentapotassium salt of cobalt ethylenediamine tetra (methylene phosphonic acid)
8.2 grams gold in the form of potassium cyanide The pH was adjusted to 5.0. A mirror-bright gold deposit was obtained at 90° F. at current densities from near zero to 50 amperes per square foot. Current efficiency at 10 amperes per square foot was 70.31%.

EXAMPLE 2

A gold electroplating bath was formed as in Example 1, but containing 16.4 grams gold in the form of potassium gold cyanide. A mirror-bright gold deposit was obtained at 90° F. at current densities from near zero to 100 amperes per square foot. Current efficiency at 10 amperes per square foot was 82.30%.

EXAMPLE 3

A gold electroplating bath was formed as in Example 1, except containing 0.53 grams cobalt in the form of the hexapotassium salt of cobalt nitrilotri (methylene phosphonic acid) and 0.53 grams cobalt in the form of tripotassium salt of cobalt N-carboxymethyl, N,N-di (methylene phosphonic acid). The pH was adjusted to 4.7. A mirror-bright gold deposit was obtained at 96° F. at current densities from near zero to 30 amperes per square foot. Current efficiency at 10 amperes per square foot was 61.17%.

EXAMPLE 4

A sufficient amount of water was used to form one liter of a gold electroplating solution to which was added the following:

78.73 grams tripotassium citrate
56.01 grams citric acid
1.32 grams cobalt in the form of the tripotassium salt of cobalt N-carboxymethyl, N,N-di (methylene phosphonic acid)
8.2 grams gold in the form of potassium gold cyanide.

The pH was adjusted to 4.9. A mirror-bright gold deposit was obtained at 90° F. at current densities from near zero to 50 amperes per square foot. Current efficiency at 10 amperes per square foot was 55.95%.

EXAMPLE 5

A sufficient amount of water was used to form one liter of a gold electroplating solution to which was added the following:

89.83 grams monopotassium phosphate
1.32 grams cobalt in the form of the tetrapotassium salt of cobalt nitrilotri (methylene phosphonic acid)
8.2 grams gold in the form of potassium gold cyanide.

The pH adjusted to 6.0 with KOH. A mirror-bright gold deposit was obtained at 95° F. at current densities from near zero to 50 amperes per square foot. Current efficiency at 10 amperes per square foot was 69.17%.

EXAMPLE 6

A sufficient amount of water was used to form one liter of a gold electroplating solution to which was added the following:

89.83 grams monopotassium phosphate
44.91 grams tripotassium citrate
1.32 grams cobalt in the form of the pentapotassium salt of cobalt ethylenediamine tetra (methylene phosphonic acid)
8.2 grams gold in the form of potassium gold cyanide.

The pH was 5.75. A mirror-bright gold deposit was obtained at 110° F. at current densities from near zero to 50 amperes per square foot. Current efficiency at 10 amperes per square foot was 68.52%.

EXAMPLE 7

A sufficient amount of water was used to form one liter of a gold electroplating solution to which was added the following:

44.91 grams monopotassium phosphate
78.73 grams tripotassium citrate
56.01 grams citric acid
0.53 grams cobalt in the form of pentapotassium salt of cobalt ethylenediamine tetra (methylene phosphonic acid)
1.58 grams nickel in the form of the monopotassium salt of nickel nitrilotriacetic acid
5.28 grams nickel in the form of nickel sulfate
2.1 grams gold in the form of potassium gold cyanide The pH was adjusted to 4.8. A mirror-bright gold based alloy deposit was obtained at 90° F. at current densities from near zero to 25 amperes per square foot.

EXAMPLE 8

A sufficient amount of water was used to form one liter of a gold electroplating solution to which was added the following:

44.91 grams monopotassium phosphate
78.73 grams tripotassium citrate
56.01 grams citric acid
0.53 grams cobalt in the form of pentapotassium salt of cobalt ethylenediamine tetra (methylene phosphonic acid)
0.53 grams copper in the form of triethanolamine complex
2.10 grams gold in the form of potassium gold cyanide The pH was adjusted to 4.9. A mirror-bright gold-based alloy deposit was obtained at 90° F. at current densities from near zero to 25 amperes per square foot.

EXAMPLE 9

A sufficient amount of water was used to form one liter of a gold electroplating solution to which was added the following:

44.91 grams Monopatassium Phosphate
78.73 grams Tripotassium Citrate
56.01 grams Citric Acid
0.53 grams Cobalt in the form of the Penta Potassium salt of cobalt ethylenediamine tetra (methylene phosphonic acid)
0.13 grams Cadmium in the form of cadmium acetate
2.10 grams gold in the form of potassium gold cyanide The pH was adjusted to 4.8. The mirror-bright gold based alloy deposit was obtained at 90° F. at current densities from 1 to 25 amperes per square foot.

EXAMPLE 10

A sufficient amount of water was used to form one liter of a solution containing the following:

| | | |
|---|---|---|
| 119.94 grams | Diammonium Citrate | pH = 4.3 |
| 52.31 grams | Citric Acid | |
| 1.32 grams | Nickel as the Penta Ammonium salt of nickel ethylenediamine tetra (methylene phosphonic acid) | |
| 8.22 grams | gold as potassium gold cyanide. | |

A bright deposit was obtained at 110° F. at current densities from near zero to over 20 ASF. The current efficiency at 10 ASF was 54.00 percent.

EXAMPLE 11

A sufficient amount of water was used to form one liter of a solution containing the following:

| | | |
|---|---|---|
| 119.94 grams | Diammonium Citrate | pH = 4.3 |
| 52.31 grams | Citric Acid | |
| 1.32 grams | Nickel as the Tetra Ammonium salt of nickel nitrilotri (methylene phosphonic acid) | |
| 8.22 grams | gold as potassium gold cyanide | |

A bright deposit was obtained at 110° F. at current densities from near zero to over 25 ASF. The current efficiency at 10 ASF was 51.96 percent.

EXAMPLE 12

A sufficient amount of water was used to form one liter of a solution containing the following:

| | | |
|---|---|---|
| 89.82 grams | Tripotassium Citrate | pH = 4.3 |
| 59.97 grams | Citric Acid | |
| 1.98 grams | Nickel as the tetra potassium salt of nickel nitrilotri (methylene phosphonic acid) | |

A bright deposit was obtained at 90° F. at current densities from near zero to over 25 ASF. The current efficiency at 10 ASF was 45.51 percent.

EXAMPLE 13

A sufficient amount of water was used to form one liter of a solution containing the following:

44.91 grams Citric Acid
39.10 grams Diammonium Citrate
30.91 grams Diammonium phosphate
1.98 grams Nickel as the penta ammonium salt of nickel ethylenediamine tetra (methylene phosphonic acid)
8.22 grams gold as potassium gold cyanide.

The pH was adjusted to 4.7. A bright deposit was obtained at 92° F. at current densities from near zero to over 20 ASF. The current efficiency at 10 ASF was 54.00 percent.

EXAMPLE 14

A sufficient amount of water was used to form one liter of a solution containing the following:

44.91 grams Monopotassium phosphate
78.73 grams Tripotassium Citrate
56.01 grams Citric Acid
2.11 grams Nickel as the tetrapotassium salt of nickel nitrilotri (methylene phosphonic acid)
8.22 grams gold as potassium gold cyanide.

The pH was adjusted to 4.2. A mirror bright gold deposit was obtained at 110° F. at current densities from near zero to over 25 ASF. The current efficiency at 10 ASF was 44.21 percent.

The foregoing examples are illustrative of the type of results which can be obtained by the use of the brightening agents and plating baths of this invention. Although the examples describe the phosphate, citrate, and phosphate-citrate types of electrolyte systems, it will be understood that other electrolyte systems are equally useful. It will likewise be understood that other chelated cobalt or nickel compounds falling within the scope of the claims are useful in fulfilling the objectives of the invention.

I claim:

1. In an electroplating bath for the deposition of bright gold or gold alloy electrodeposits, comprising an aqueous solution of a soluble gold cyanide, supporting electrolyte and brightening agent, buffered to a pH of about 4.5–6.0, the improvement which comprises employing as said brightening agent, at least one fully neutralized potassium, sodium, or ammonium salt of the codepositable metal chelate of an organophosphorus chelating agent, wherein said codepositable metal is cobalt or nickel.

2. The electroplating bath of claim 1 wherein the organophosphorus chelating agent is of the formula $$R'_{(3-n)}-N-[R-\overset{O}{\overset{\|}{P}}-(OH)_2]_n$$

wherein R is lower alkylidene or a water soluble salt thereof, R' is H, lower alkyl or carboxyalkyl, and n is 1–3.

3. The electroplating bath of claim 2 wherein the brightening agent is the tetra salt of codepositable metal nitrilotri (methylene phosphonic acid).

4. The electroplating bath of claim 2 wherein the brightening agent is the tetra salt of codepositable metal nitrilotri (ethylidene phosphonic acid).

5. The electroplating bath of claim 2 wherein the brightening agent is the tetra salt of codepositable metal nitrilotri (isopropylidene phosphonic acid).

6. The electroplating bath of claim 2 wherein the brightening agent is the tri salt of codepositable metal N-carboxymethyl, N,N-di (methylene phosphonic acid).

7. The electroplating bath of claim 1 wherein the organophosphorus chelating agent is of the formula $$[(HO)_2-\overset{O}{\overset{\|}{P}}-R]_x-\overset{R'_{(2-x)}}{\overset{|}{N}}-(CH_2)_y-\overset{R'_{(2-x)}}{\overset{|}{N}}-[R-\overset{O}{\overset{\|}{P}}-(OH)_2]_x$$

wherein R is lower alkylidene or a water soluble salt thereof, R' is H, lower alkyl or carboxyalkyl, x is 1 or 2 and y is 1–6.

8. The electroplating bath of claim 7 wherein the brightening agent is the penta salt of codepositable metal ethylenediamine tetra (methylene phosphonic acid).

9. The electroplating bath of claim 7 wherein the brightening agent is the tri salt of codepositable metal ethylenediamine N,N'-di (carboxymethyl), N,N'-di (methylene phosphonic acid.

10. The electroplating bath of claim 7 wherein the brightening agent is the penta salt of cobalt hexamethylenediamine tetra (methylene phosphonic acid).

11. The electroplating bath of claim 7 wherein the brightening agent is the tri salt of cobalt hexamethylenediamine N,N'-di (carboxymethyl), N,N'-di (methylene phosphonic acid).

12. The electroplating bath of claim 1 wherein the brightening agent is the di salt of cobalt 1-hydroxyalkylidene, 1,1 diphosphonic acid.

13. In the method of electroplating a substrate to obtain a bright gold or gold alloy electrodeposit in an aqueous solution of a soluble gold cyanide at a pH of about 4.5–6.0 in the presence of a brightening agent, the improvement which comprises employing as said brightening agent, at least one fully neutralized potassium, sodium or ammonium salt of the codepositable metal chelate of an organophosphorous chelating agent, wherein said codepositable metal is cobalt or nickel.

14. The method of claim 13 wherein said organophosphorous chelating agent is of the formula $$R'_{(3-n)}-N-[R-\overset{O}{\overset{\|}{P}}-(OH)_2]_n$$

wherein R is lower alklidene or a water soluble salt thereof, R' is H, lower alkyl or carboxyalkyl, and n is 1–3.

15. The method of claim 13 wherein said organophosphorous chelating agent is of the formula $$[(HO)_2-\overset{O}{\overset{\|}{P}}-R]_x-\overset{R'_{(2-x)}}{\overset{|}{N}}-(CH_2)_y-\overset{R'_{(2-x)}}{\overset{|}{N}}-[R-\overset{O}{\overset{\|}{P}}-(OH)_2]_x$$

wherein R is lower alkylidene or a water soluble salt thereof, R' is H, lower alkyl or carboxyalkyl, x is 1 or 2 and y is 1–6.

16. A solution for the electrodeposition of gold or gold alloys comprising an aqueous solution of a soluble gold cyanide, a supporting electrolyte, and a brightening agent wherein said brightening agent comprises at least one fully neutralized potassium, sodium or ammonium salt of the codepositable metal chelate of an organophosphorus metal chelating agent, and wherein said codepositable metal is cobalt or nickel, said solution having a pH of about 4.5–6.0.

* * * * *